US006762425B1

(12) United States Patent
Strait

(10) Patent No.: US 6,762,425 B1
(45) Date of Patent: Jul. 13, 2004

(54) PORTABLE DEVICE FOR CURING GEL NAIL PREPARATIONS

(76) Inventor: Gloria Strait, 2650 Rte. 209, Wurtsboro, NY (US) 12790

( * ) Notice: Subject to any disclaimer, the term of this patent is extended or adjusted under 35 U.S.C. 154(b) by 0 days.

(21) Appl. No.: 10/671,371

(22) Filed: Sep. 25, 2003

(51) Int. Cl.[7] ..... G21K 5/08

(52) U.S. Cl. ..... 250/504 R; 250/492.1; 250/455.11

(58) Field of Search ..... 250/504 R, 492.1, 250/455.11

(56) References Cited

U.S. PATENT DOCUMENTS

| | | | | |
|---|---|---|---|---|
| 2,374,472 A | | 4/1945 | Corbett | 34/202 |
| 3,864,847 A | | 2/1975 | Friedman et al. | 34/104 |
| 4,731,541 A | | 3/1988 | Shoemaker | 250/504 R |
| 4,979,523 A | * | 12/1990 | Grimm | 250/504 R |
| 4,988,883 A | | 1/1991 | Oppawsky | 250/492.1 |
| 5,130,551 A | * | 7/1992 | Nafziger et al. | 250/492.1 |
| 5,130,553 A | * | 7/1992 | Amoh | 250/492.1 |
| 5,249,367 A | | 10/1993 | Nafziger et al. | 34/14 |
| 5,515,621 A | | 5/1996 | Bloom | 34/275 |
| 5,658,184 A | * | 8/1997 | Hoopman et al. | 451/28 |
| D394,917 S | | 6/1998 | Bloom | D28/58 |
| 6,518,583 B1 | | 2/2003 | Hennig | 250/504 R |

* cited by examiner

*Primary Examiner*—John R. Lee
*Assistant Examiner*—Erin-Michael Gill
(74) *Attorney, Agent, or Firm*—Sandra M. Kotin

(57) ABSTRACT

This device utilizes UV light to cure gel nail preparations as applied to finger and toe nails. The device can be used to treat one or both hands or one or both feet with no changes or adjustments required. A housing has three horizontal openings in the front wall, each opening accessing a separate compartment containing a UV light source which is situated so as to provide radiation directly to the areas where the nails are placed. The compartment walls are coated with reflective material and specifically shaped to maximize the radiation to those areas. The index and three fingers of one or both hands are inserted into the uppermost compartment where the UV lamp is situated in the ceiling and the thumbs are inserted into the middle compartment where the UV lamp is situated in the floor. This arrangement permits all fingers to lie flat eliminating any distortion or pooling of the gel material and so each nail receives maximum radiation. A longitudinal hand rest is disposed between the uppermost and middle openings. The feet are placed in the lowermost compartment where the UV lamp is situated in the ceiling. The device can be powered by line current or a rechargeable battery enabling the device to be used near water or in areas where there is no accessible electric outlet. A control panel and timer enable selecting the correct lamps and time for treatment.

20 Claims, 8 Drawing Sheets

PORTABLE DEVICE FOR CURING GEL NAIL PREPARATIONS

FIELD OF THE INVENTION

The instant invention relates to a portable device for use in curing gel nail preparations and nail extensions applied to both fingernails and toenails.

BACKGROUND OF THE INVENTION

Since the use of nail enamels and polishes became widespread a number of devices have been developed to accelerate the drying process. These ranged from standing before a fan to placing the hands in a chamber with circulating air or heating bulbs. A review of some of the prior art polish drying devices provides insight as to the variety and designs developed for this purpose. In recent years acrylic and gel materials have been applied to nails to form more desirable nail shapes and lengths. Such products require exposure to a light source, usually a n ultra violet light source, to cure the gels. The prior art in this area is limited. Additionally, most of the devices designed to cure fingernail preparations would fall short when the gels are applied to toenails because most of the devices were not designed to accommodate feet.

Corbett, in U.S. Pat. No. 2,374,472, designed an apparatus for drying nail enamel that consisted of a chamber with a U-shaped opening in the top that defined a hand rest. A light bulb centrally located near the interior floor of the chamber provided the heat. The hand was inserted so the fingers closed over the hand rest with all nails facing downward toward the light source. The design of this device may be considered for use with gel nail preparations, but since the gel preparations tend to flow before they are completely cured, when the nails all facing downward there could be an uneven surface due to pooling of the gel material toward the lowermost surface of the nails. This would require reshaping of all the nails after they are cured. Also, by curling the hand over the hand rest it is possible that the some fingers could contact the nails of other fingers while the gel material is still fluid. The design of this device can only accommodate one hand at a time and cannot be used to cure toenail preparations.

Another nail drying chamber was disclosed by Friedman et al. in U.S. Pat. No. 3,864,847. This chamber had a front opening with a slidable tray situated at the bottom. The heat was provided by infra-red bulbs affixed to the inside of the top wall. The hand or foot could be placed flat on the tray and slid into the chamber. If the chamber became too hot the user could slide the tray out of the chamber. Such infra-red source would generate too much heat and would not be useful with gel preparations. The design itself would not work well with gels since the hand is placed flat on the tray. When the hand is flat the thumb is on a slant. Since the light source is above the tray, the portion of the thumbnail facing to the side and downward would not receive the direct light so the gel material could flow before it is cured. The flow of the gel before being completely cured would be toward the skin around the thumbnail. It is inadvisable to have the uncured gel material make contact with the skin.

A nail polish dryer using UV light bulbs was taught by Nafziger et al. in U.S. Pat. No. 5,249,367. A drying chamber had a pivotally attached cover that can be adjusted to alter the height of the cover. Two openings in the front wall accommodate the right and left hands or the right and left feet. The interior of the chamber is lined with a textured material that is opaque to UV light. The hands must be placed flat on the interior base so that the thumbs are at an angle making this design undesirable for use with gel fingernails for the same reasons as noted above. Additionally, an error in adjusting the height of the cover could result in an improper distance from the light source to the nails resulting in a less than desirable result.

Bloom devised an elongated nail drying apparatus that can be used by up to ten persons simultaneously (U.S. Pat. No. 5,515,621). This device utilizes overhead UV lamps and an angled air pressure chamber equipped with circulating fans to expel a "pillow of air" over the drying nails. Users can sit or stand on either side of the unit and place their hands flat on a long horizontal hand rest located directly beneath the overhead unit. In addition to the problem of having the thumbs at an angle when the hands are flat, the lamps and air circulation must be left on to accommodate the multiple users. This system would not be practical for use with gel nails since the time of exposure to the UV light must be carefully controlled by the nail operator making its use by more than one person at a time impractical. Bloom also teaches a design for a similar apparatus having an elevated hand rest (U.S. Pat. No. Des. 394,917).

Shoemaker, in U.S. Pat. No. 4,731,541, teaches an apparatus for curing photocurable gels on fingernails. The apparatus consists of a support arm with a clamp at the bottom for attachment to a table and a circular chamber, ellipsoid in cross section, secured at the top. A handle with finger indentations extends from the underside of the circular chamber by means of a telescoping shaft and is gripped by the hand with the palm facing upward and the fingers curling over the handle surface. The user then pushes the handle upward into the chamber and at the same time activates a circular UV lamp. A timer can also be used with this system. All of the fingers are facing upward, but depending on the size of the hand, the nails may make contact with each other or the central shaft or the fingers may not reach around the handle to be flat against it. Since the gel material sets up quickly, the nails could cure to the shaft creating a problem or the fingers could be not quite flat creating pooling of the gel material. Additionally, only the fingers of one hand can be treated at a time and the palm up orientation of the hand with no arm rest can be uncomfortable. Some upward force must be exerted by the user to activate the system. The device of Shoemaker can only be used on tables, and more specifically on tables without a rim or border. The device of Shoemaker cannot be used to cure toenail preparations. Another apparatus for use in the curing of photopolymerizable plastics on fingernails is taught by Oppawsky in U.S. Pat. No. 4,988,883. A housing with a top opening surrounded by a glare protection rim contains an annular radiation lamp. The inner walls of the housing are reflective. A spring mounted hand support having a series of grooves to accept the various fingers is centrally located within the top opening. The grooves are designed for specific fingers and can accommodate the right and left hands, one at a time. The user places her band on the hand support and the pressure of the hand lowers the support into the housing and activates the lamp. All of the fingers are oriented downwardly around the support so that any tendency of the polymeric material to flow would cause pooling toward the ends of the nails requiring additional shaping of all nails after curing. Only one hand can be treated at a time and feet cannot be accommodated in this apparatus.

An apparatus specifically designed to harden the gel materials currently in use for fingernails is taught by Hennig in U.S. Pat. No. 6,518,583. A circular housing with a front opening holds two U-shaped UV light sources angularly mounted on opposing sides of the interior top of the housing. A hand bearing surface is located on the base inside a front opening. The bearing surface is convex and the angles of the surface conform to the angles of the placement of the lights to provide maximum radiation to the nail surfaces. Though the curvature of the bearing surface places the nails of the first and fifth fingers at slight angles, the angled lights allow all surfaces to receive the full benefit of the radiation. A timer may be used to insure proper irradiation periods. Only one hand can be placed in the housing at a time, and this design cannot accommodate feet.

There have been several designs for systems that could be used to cure synthetic nail preparations but most cannot be used for both hands at the same time, and none can do so while still having all nails in proper orientation so there is no pooling of material and no chance of the material making contact with the skin. None of the systems designed for polymeric preparations can accommodate hands and feet nor can they accommodate both hands or both feet at the same time. All of the prior art systems rely on conventional electric outlets and line current as the power source and therefore must be used near such a source of electricity and cannot be used near water. They also cannot be used at any location within a spa or salon where a client may be situated if there is no electric outlet close by.

Though there have been patents for a variety of devices for curing nail preparations, the one currently available commercially is a simple chamber with one entry port having a flat bearing surface. This unit is manufactured by Star Nail Products, Inc. of Valencia, Calif., and does not exhibit a model number. The unit is designed to have one hand at a time placed flat on the bearing surface. When all five fingers are treated at the same time the thumb must be on a slant and the gel material on the thumbnail cannot receive the UV radiation uniformly. In use, many operators choose to have the four fingers cured first, by having them placed flat on the bearing surface, and thereafter the thumb is inserted flat. Therefore, each hand requires two curing times and both hands require four curing times. This wastes time for the operator and the client, because four curing times are needed and also because, for best results, the gel preparation may be applied four times, just before curing, so that the material is not smudged or cannot come in contact with the skin before being cured. Star Nail Products also sells a unit that can accommodate two hands or two feet, but there is only one horizontal opening and the hands must be placed flat on the bearing surface.

There is a need for a nail curing device that can accommodate one or both hands and such that all nails are at the correct orientation for proper exposure to the source of UV light. There is a need for a nail curing device that can also accommodate feet, that requires no adjustments to do so, and that can be placed anywhere the client is comfortably situated in a spa or salon. There is a need for such a device that can be used near water and away from electric outlets.

BRIEF SUMMARY OF THE INVENTION

The present invention provides a device for use in curing gel nail preparations. The device can be used with line current or operated on a battery so that it can be placed anywhere, on any surface, and does not present a problem when used near water. The device may be used for curing fingernails and toenails and can accommodate one or both hands at the same time, or one or both feet.

An object of the present invention is to provide a device that can cure all five nails on both hands at the same time so as to conserve time for the operator and for the client.

It is an object of the present invention to provide a device that can be used for both fingernails and toenails with no adjustments or changes required.

It is another object of the present invention to provide a device that operates on both line current and battery power.

It is a further object of the present invention to have a rechargeable battery as the battery power source.

A still further object of the present invention is to be able to switch from line current to battery by simply removing the line current connection allowing the device to work from the battery.

Another object of the present invention is to have a retractable cord so that the cord is not hanging nor is it subject to tangling when the unit is used on battery power.

A still further object of the present invention is to provide a device that can be used anywhere on any surface such as a table, a stool, or on the floor.

A further object of the present invention is to provide a device that can be used for one hand or one foot or can just as easily accommodate two hands or two feet at the same time with no adjustments.

Another object of the present invention is to provide a device that enables all fingernails to be at the proper orientation so that all nail preparations will be cured at the same time with minimal distortion or skin contact with the uncured gel material.

A still further object of the present invention is to have the device accommodate hands of different sizes comfortably with no distortion to the finished nails.

A portable device for use in curing gel nail preparations on human hands and feet comprises a housing having a front wall, a back wall, two side walls, a top and a bottom, the front wall having three horizontal openings therethrough, an uppermost opening, a middle opening and a lowermost opening. There are three compartments situated within the housing, a first compartment accessed through the uppermost opening, a second compartment accessed through the middle opening and a third compartment accessed through the lowermost opening. Three partitions are disposed within the housing, a first partition defining the first compartment, a second partition defining the second compartment and a third partition defining the third compartment, each partition forming the walls of the compartment and including a floor and a ceiling. There are three UV lamps, a first UV lamp affixed near the ceiling of the first compartment, a second UV lamp affixed near the floor of the second compartment, and a third UV lamp affixed near the ceiling of the third compartment. When the index and three fingers of the hands are placed flat on the floor of the first compartment and the thumbs are placed flat against the ceiling of the second compartment, radiation from the first UV lamp is directed toward the floor of the first compartment and radiation from the second UV lamp is directed toward the ceiling of the second compartment so the fingernails receive direct radiation, and when the feet are placed flat on the floor of the third compartment, radiation from the third UV lamp is directed toward the floor of the third compartment and the toe nails receive direct radiation.

A portable device for use in curing gel nail preparations on human hands and feet comprises a housing having a front wall, a back wall, two side walls, a top and a bottom, the front wall having three horizontal openings therethrough, an uppermost opening, a middle opening and a lowermost opening. There are three compartments situated within the housing, a first compartment accessed through the uppermost opening, a second compartment accessed through the middle opening and a third compartment accessed through the lowermost opening. Three partitions are disposed within the housing, a first partition defining the first compartment, a second partition defining the second compartment and a third partition defining the third compartment, each partition forming the walls of the compartment and including a floor and a ceiling. There are three UV lamps, a first UV lamp affixed near the ceiling of the first compartment, a second UV lamp affixed near the floor of the second compartment, and a third UV lamp affixed near the ceiling of the third compartment. There are two power means for activating the UV lamps which comprise both line current and a rechargeable battery. The device operates by line current and when the line current is disconnected the device operates by means of the battery. When the index and three fingers of the hands are placed flat on the floor of the first compartment and the thumbs are placed flat against the ceiling of the second compartment, radiation from the first UV lamp is directed toward the floor of the first compartment and radiation from the second UV lamp is directed toward the ceiling of the second compartment so the fingernails receive direct radiation, and when the feet are placed flat on the floor of the third compartment, radiation from the third UV lamp is directed toward the floor of the third compartment and the toe nails receive direct radiation.

Other features and advantages of the invention will be seen from the following description and drawings.

DETAILED DESCRIPTION OF THE INVENTION

Figure 1:
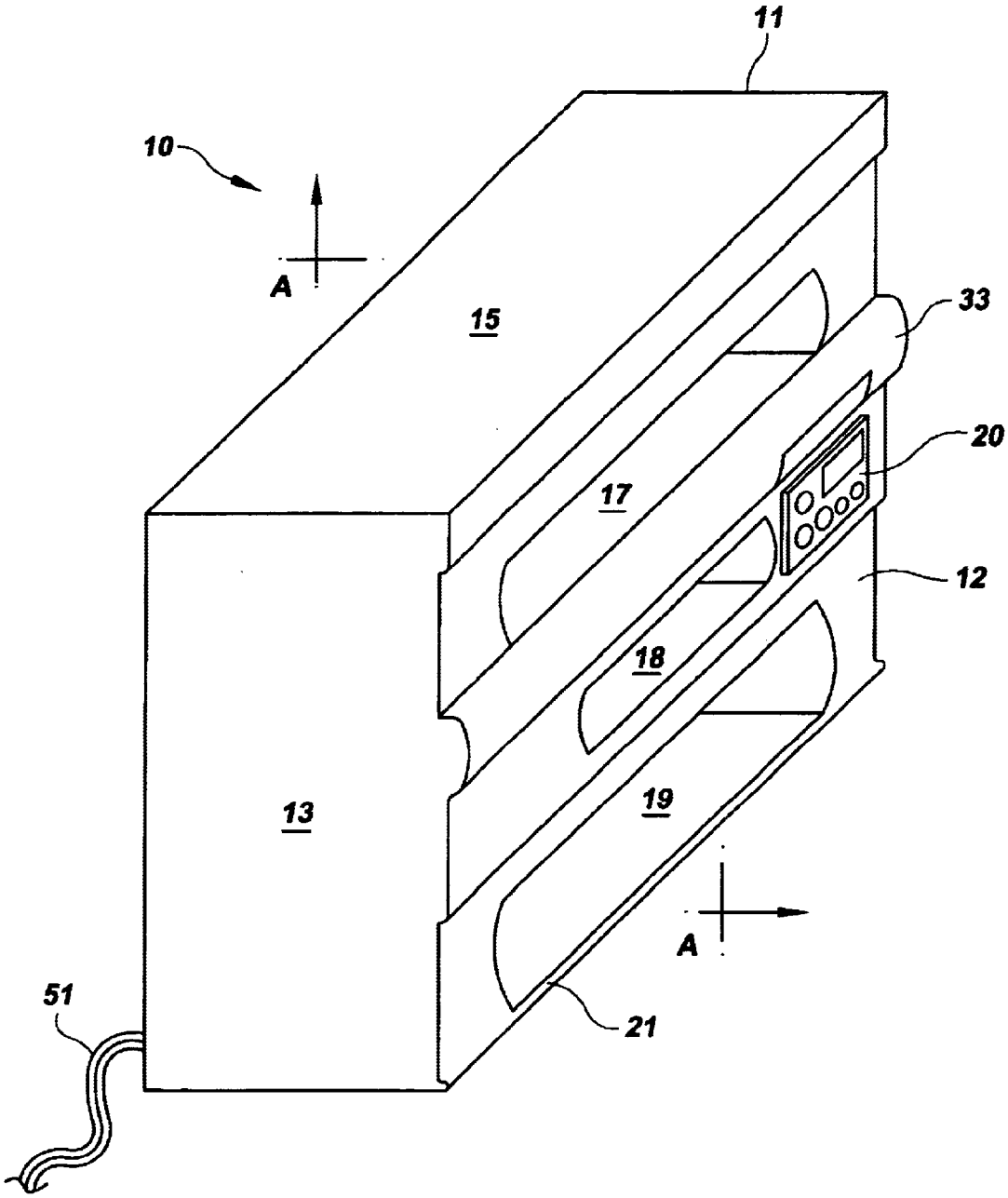
FIG. 1 is a perspective view of the device of the present invention.

The instant invention is a device 10 that may be used to cure gel nail extensions and overlays. A housing 11 may hold the UV light sources needed to cure the gel preparations. Referring to FIG. 1, the housing 11 may have a front wall 12, two side walls 13, a rear wall 14, a top 15 and a bottom 16. There may be three horizontal openings in the front wall 12. The uppermost opening 17 which may be substantially the width of the front wall 12, the middle opening 18 which may be somewhat narrower, but centered, and the lowermost opening 19 which may also be substantially the width of the front wall 12 and may be adjacent to the bottom edge 21 of the front wall 12. There may also be a control panel 20 in the front wall 12.

Figure 5:
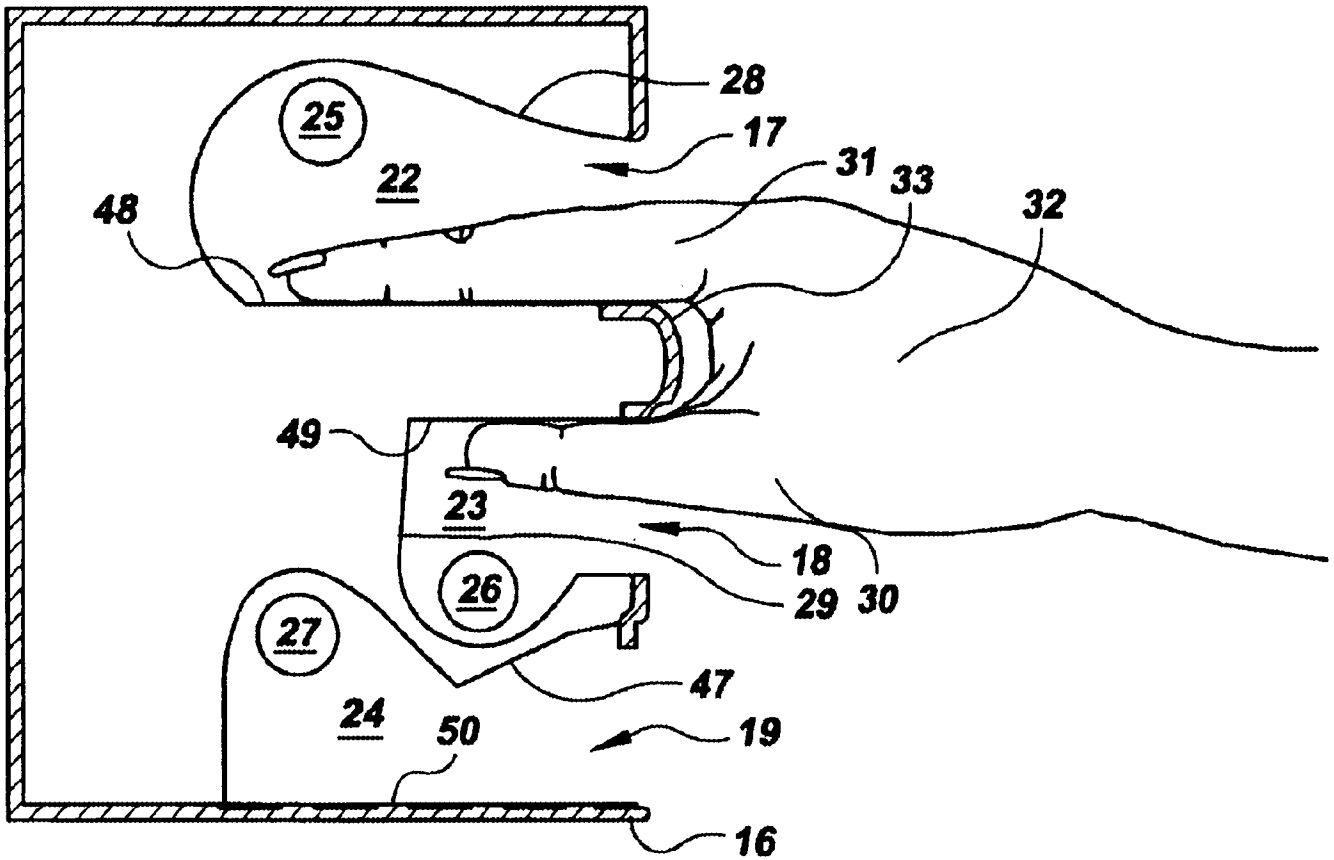
FIG. 5 is a cutaway side view of the device through line A—A of FIG. 1 with a hand inserted into the housing.
Figure 7:
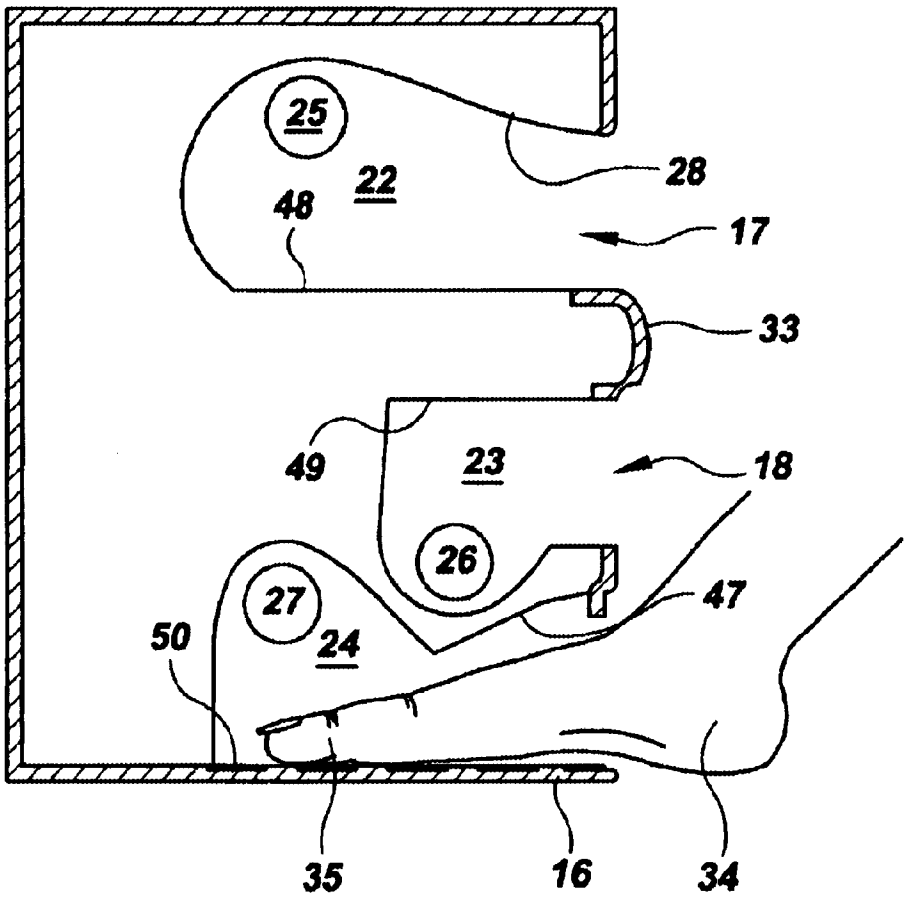
FIG. 7 is a cutaway view of the device through line A—A of FIG. 1 with a foot inserted into the housing.

The housing 11 may be divided into three interior compartments as may be seen in FIGS. 5 and 7. The first compartment 22 may be accessed through the uppermost opening 17 and may contain a first UV lamp 25 affixed near the ceiling of the compartment so that the radiation may be directed at the floor 48 of the first compartment 22. The second compartment 23 may be accessed through the middle opening 18 and may contain a second UV lamp 26 affixed near the floor of the second compartment 23 so the radiation may be directed upward toward the ceiling 49 of the second compartment 23. The third compartment 24 may be accessed through the lowermost opening 19 and may have a third UV lamp 27 affixed near the ceiling of the third compartment 24 so the radiation may be directed at the floor 50 of the third compartment 24.

Again referring to FIGS. 5 and 7, a first partition 28 may define the first compartment 22, a second partition 29 may define the second compartment 23, and a third partition 47 may define the third compartment 24. The partitions may be specifically shaped to accommodate the body parts to be placed into each compartment and to insure that the compartments are large enough to accommodate those body parts yet small enough so that the partitions which constitute the walls of each compartment are not too distant from the body parts and specifically from the nails to be treated. The inner surface of the partition defining each compartment may be coated with a reflective material to reflect and enhance the UV radiation from the lamps. If the compartments are too large and the walls too distant from the nails, a reflective surface would have little benefit since the intensity of the radiation varies inversely as the square of the distance. Therefore, the compartments may be large enough to comfortably accommodate hands and feet of various sizes yet small enough for the UV radiation to be usefully reflected from the walls with no chance of contact by the nails with the walls of each compartment. The partitions may be uniquely shaped to suit the individual needs of each compartment. The specific curves of the surfaces of each partition, as seen in FIGS. 5 and 7, may best concentrate the UV radiation toward the nails to be treated.

Figure 4:
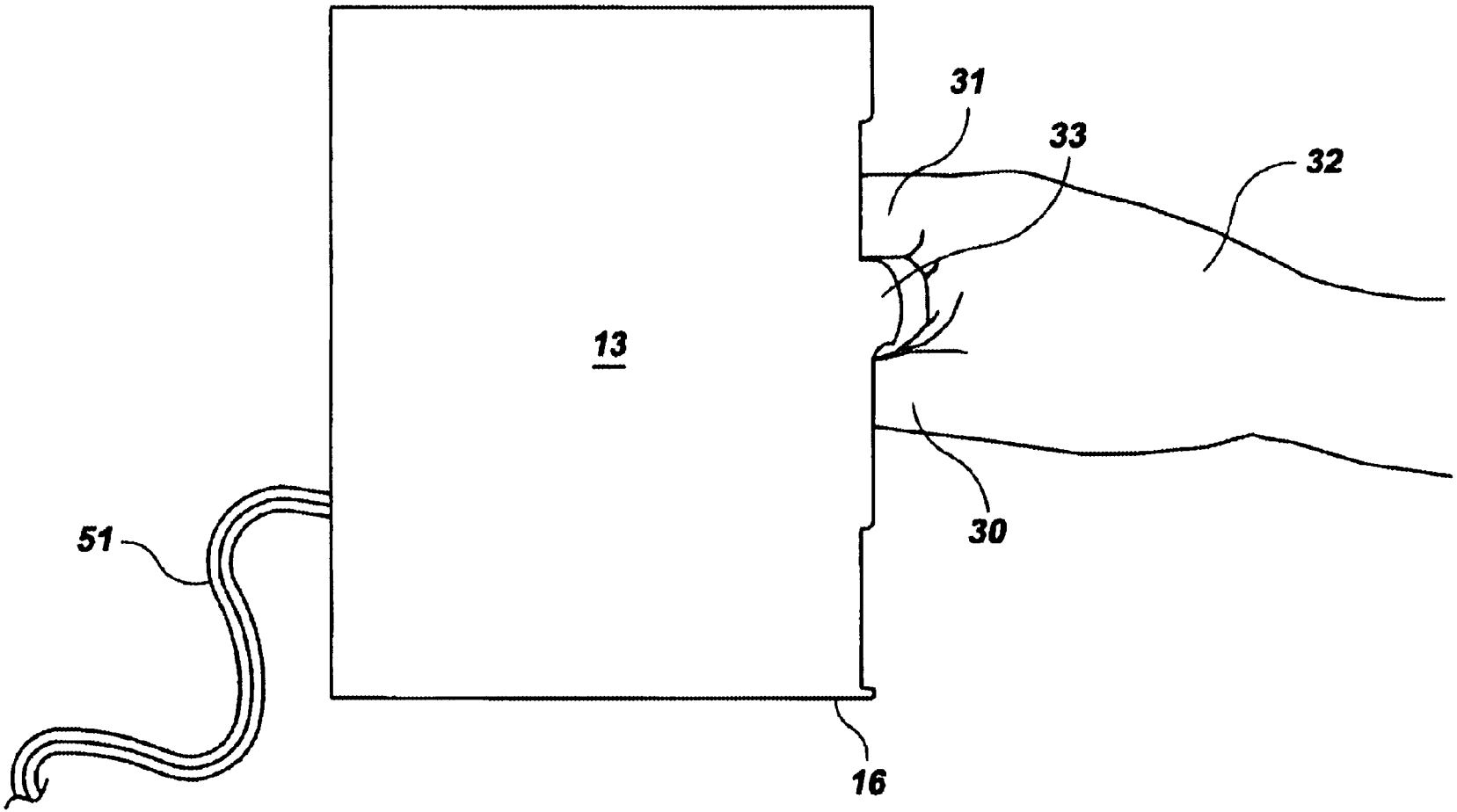
FIG. 4 is a left side plan view of the device with a hand inserted into the housing.

The gel preparation may be applied to the nails of both hands. No curing may take place until the preparations are exposed to the UV radiation. It is for this reason that all nails should face the light source, for maximum exposure and an even cure. In use, a person having her fingernails treated may place her hand 32 (or hands) into the two upper compartments in such a manner that nails may be all horizontal, flat, and may receive the maximum radiation, all at the same time. The index finger 31 and other three fingers may be inserted into the first compartment 22 through the uppermost opening 17 so that the fingers lie flat against the floor 48 of the first compartment 22. At the same time the thumb 30 may be inserted into the second compartment 23 through the middle opening 18 so that the thumb 30 may rest flat against the ceiling 49 of the middle compartment 23. (FIGS. 4 and 5) Though the thumbs may be upside down, the gel material may begin to cure as soon as the UV lights are turned on. Therefore, there is minimal, if any, pooling or flow of the gel material. Any slight pooling that may occur may be in the center of the thumbnail and may easily be filed away when the nails are smoothed after the curing step.

Figure 2:
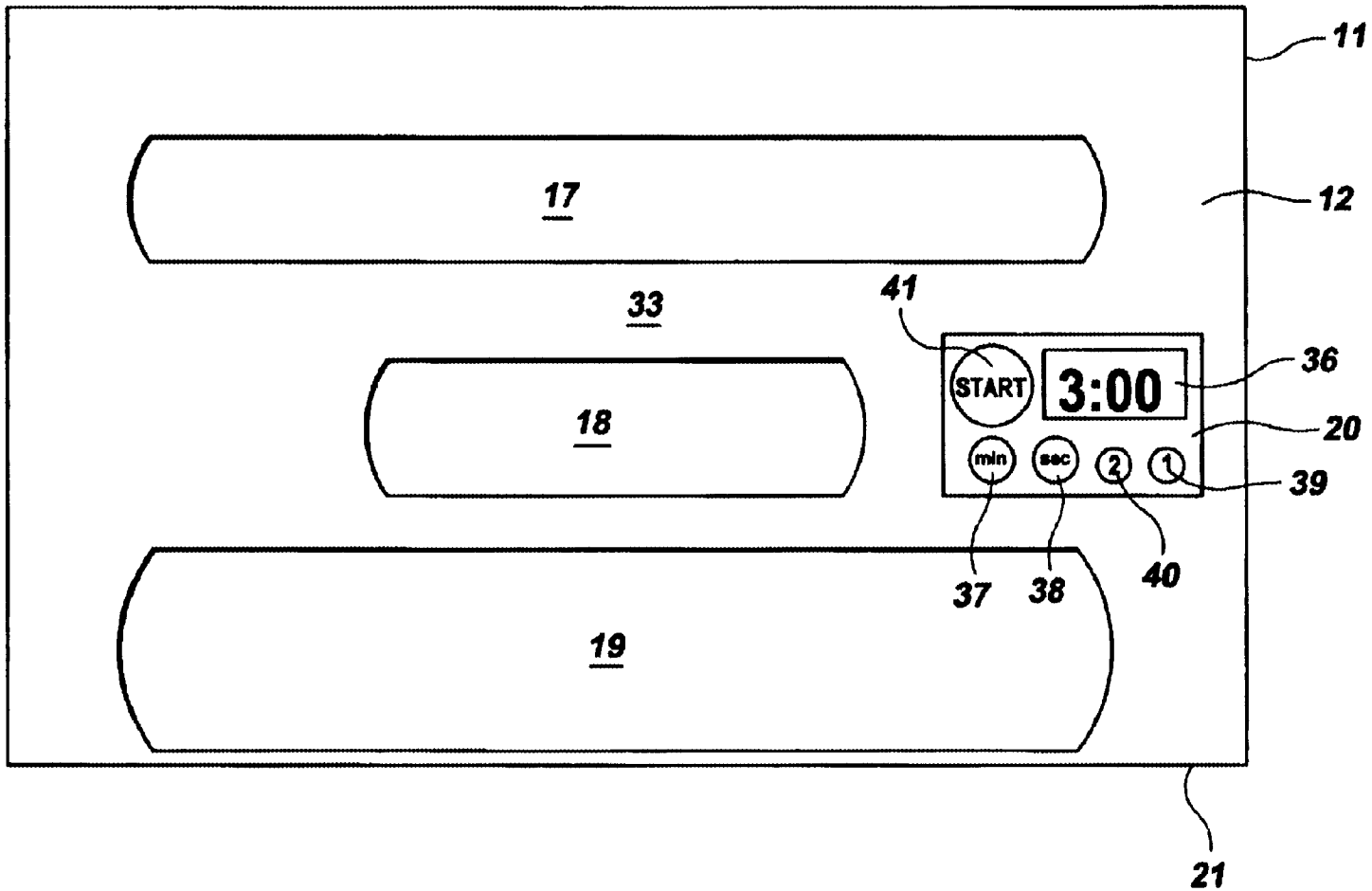
FIG. 2 is front plan view of the device of the present invention.

The vertical extend of the middle opening 18 may be greater than that of the uppermost opening 17 to better accommodate the thumb 30 at the proper orientation. This may be seen in FIG. 2. A rounded member may extend outwardly from the front wall 12 of the housing 11 between the uppermost opening 17 and middle opening 18 and may provide a hand rest 33 for the comfort of the user. The hand rest 33 may extend horizontally at least the length of the middle opening 18 or it may extend across the entire width of the front wall 12 of the housing 11. The dimensions of the device 10 may be such that the fingers of one or both hands may easily be accommodated within the first compartment 22 and second compartment 23.

Figure 6:
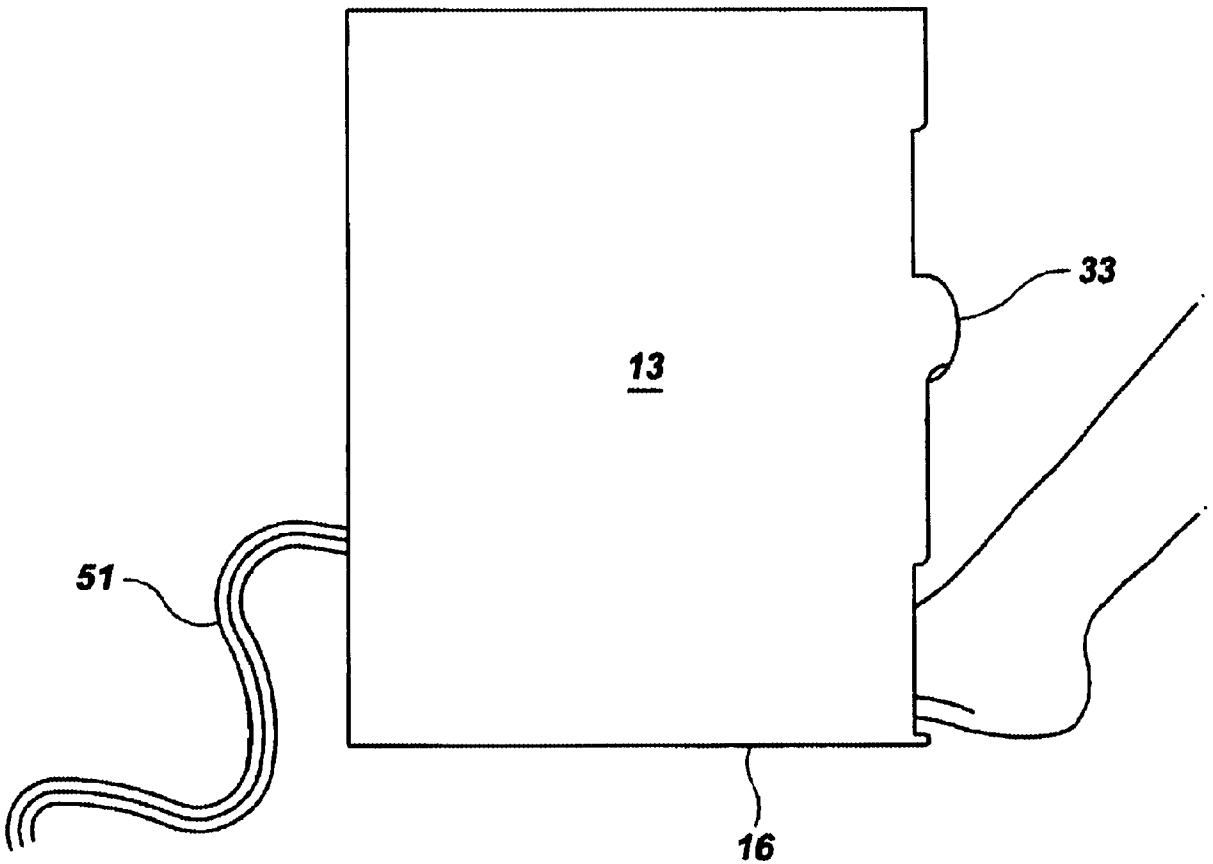
FIG. 6 is a left side plan view of the device with a foot inserted into the housing.

When gel applications to toenails are to be cured the device 10 may be placed on the floor or on a foot rest. The gel preparation may be applied to the nails of one foot 34 or both feet. One or both feet may be inserted through the lowermost opening 19 into the third compartment 24 and may rest on the floor 50 of that compartment as seen in FIGS. 6 and 7. By affixing the third UV lamp 27 near the ceiling of the third compartment, the radiation may be directed toward the toes 35. The vertical extent of the lowermost opening 19 may be substantially greater than that of the uppermost opening 17 to better accept the feet. This may be seen in FIGS. 1, 2 and 7.

The control system for the unit may take more than one form. A control panel 20 in the front wall 12 of the housing 11 may enable the operator to control which UV lamps are to be used and how long the nails are to be irradiated. There may be a timer 58 which may have an LED window 36 to indicate the number of minutes and seconds that are to be preset. Once the timer 58 is activated the changing LED readout may indicated the time passing and minutes and seconds remaining. The number of minutes may be set using a minute dial 37 and the number of seconds with a second dial 38. Alternatively, one dial may set both minutes and seconds. A start button 41 may be used to activate the system. There may also be lamp selection buttons, a first or hand button 39 which when pressed or turned may activate the first 25 and second 26 UV lamps for treatment of the fingernails, and a second or foot button 40 which when pressed or turned may activate the third UV lamp 27 for treatment of the toenails. In the alternative, the first button 39 and second button 40 may make the selection of lamp and activate the lamps without the need for a separate start button 41. The first button 39 and second button 40 may also have built in lights, 52 and 53 respectively, which may be turned on when the buttons are activated. Other function means known in the art may be utilized. See FIGS. 2 and 8.

Figure 3:
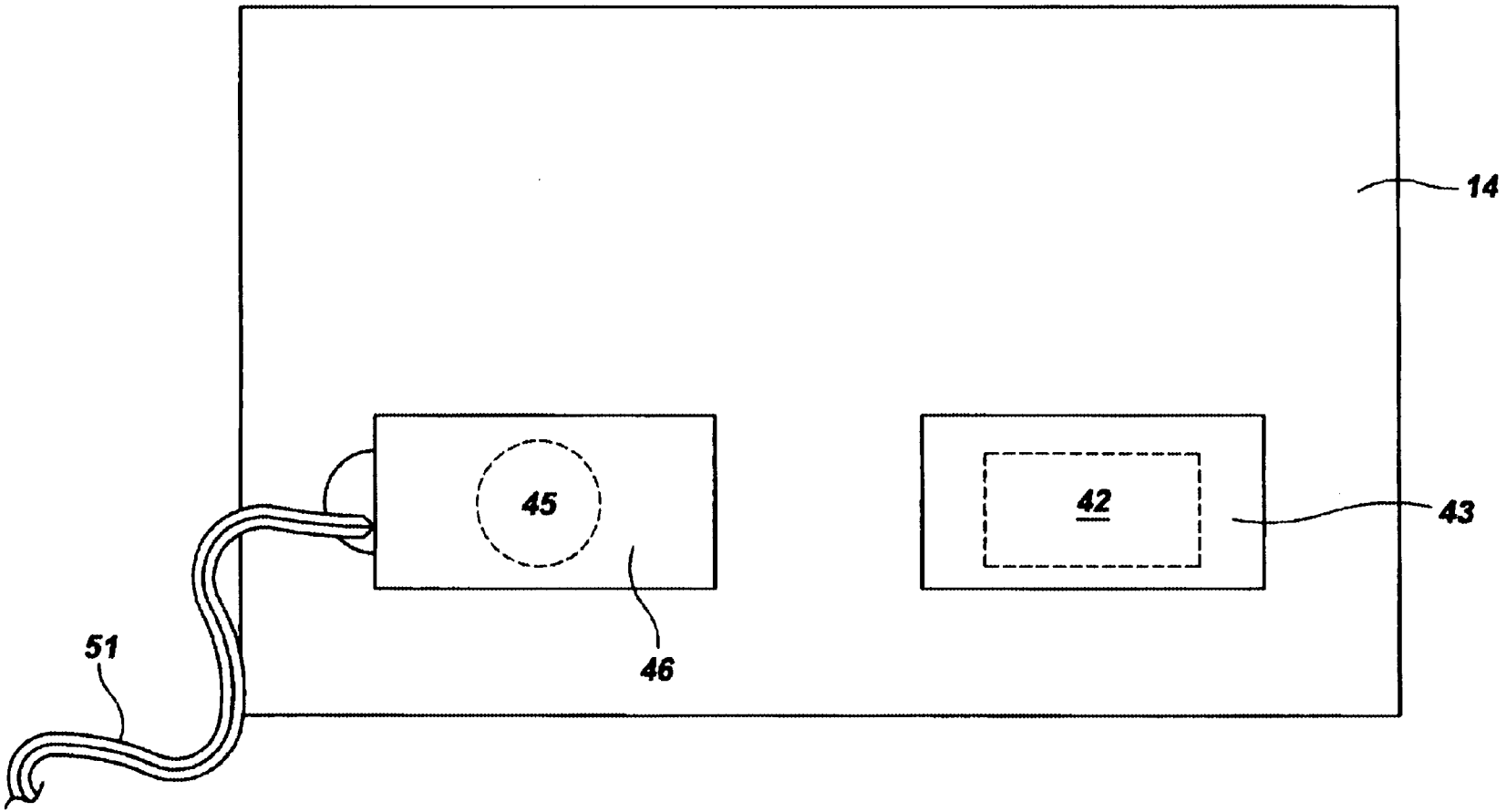
FIG. 3 is a rear plan view of the device of the present invention.
Figure 8:
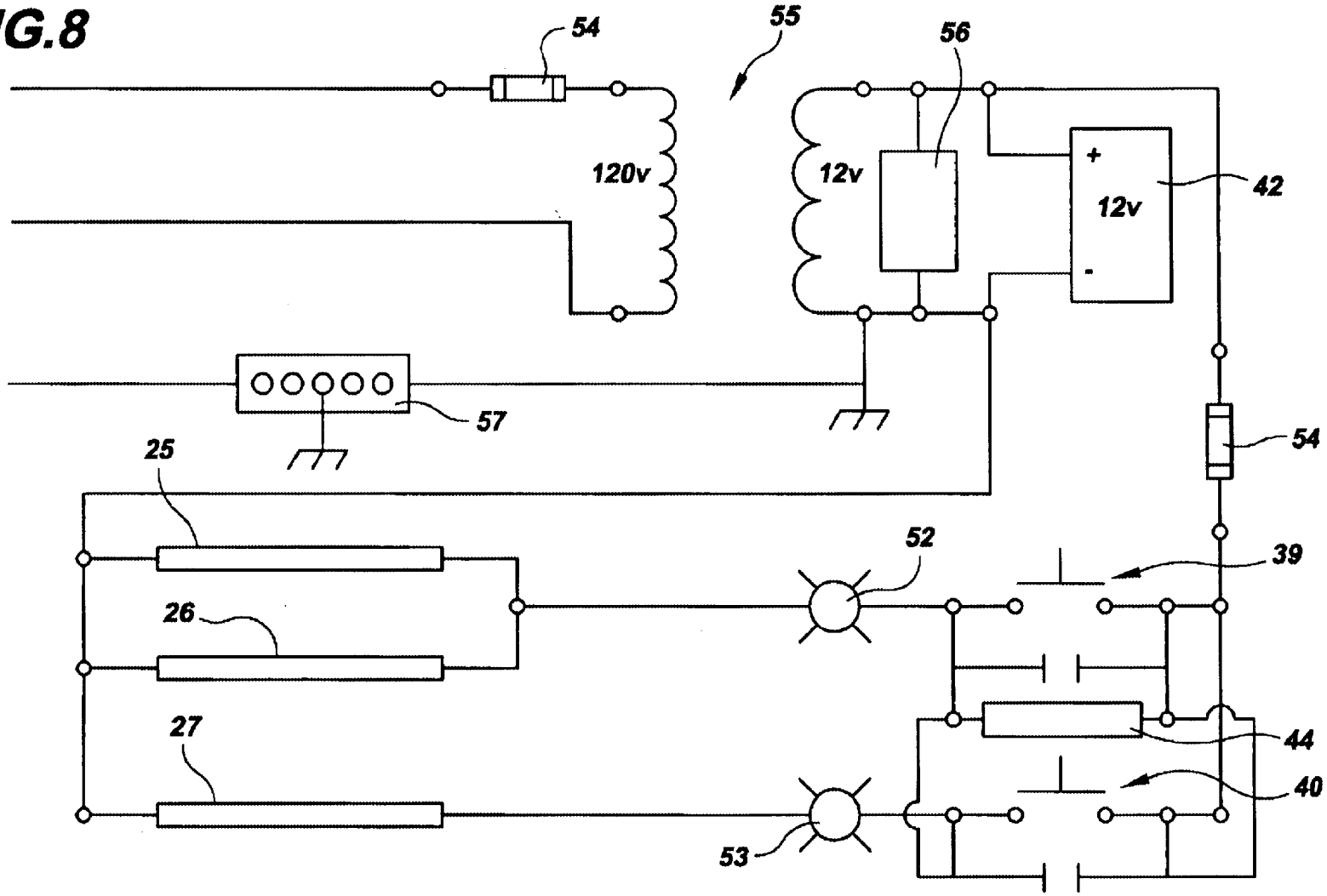
FIG. 8 is a schematic diagram of the essential parts of the electrical system of the device.

The electricity needed for the UV lamps may be provided by either line current delivered through an electric cord 51 or by a battery 42 located within the housing 11 and accessible through a panel 43 in the rear wall 14 of the housing 11. Ideally, the device may contain both power sources. The electrical circuit may be such that the device operates on 12 volt direct current. The line current may be directed through a step-down transformer 55 and a rectifier 56 in the same circuit as the battery 42 which may be constantly charging when the device is connected to a wall outlet. When the cord is removed from the outlet the device may then run by battery power. Other electrical arrangements may be used. There may also be a retractable cord mechanism 45 situated behind a second panel 46 in the rear wall 14 of the housing 11 which may be used when the device is operated by the battery so that a hanging electric cord 51 does not present a problem. (See FIG. 3) By having these alternate sources of power the device may be placed at any desired location and may not have to be placed adjacent to a wall outlet. Additionally, the presence of water may not create any hazard to the users when the device 10 is operated on battery power. Fuses 54 and a grounding strip 57 may also be included in the circuitry (FIG. 8 ).

The housing 10 may be constructed of a polymeric material or other plastic material that is resistant to UV light. The housing may be made by injection molding or may be otherwise formed. It may also be made of wood or other rigid material. The completed device 10 may be lightweight and compact so that it may easily be transported and placed where the salon or spa client is situated. The UV lamps may preferably be tubular in shape to best provide the radiation over the defined surface areas.

Since the device of the present invention may be powered by a battery, the device may be used while a person is in a hot tub, getting a massage or under a hair drier. It may also be used out of doors, in hospitals, convalescent homes, retirement residences, private residences and any other locations whether no not a wall outlet is accessible. This device enables the application of gel nail preparations to people who would otherwise not be able to receive them.

While one embodiment of the present invention has been illustrated and described in detail, it is to be understood that this invention is not limited thereto and may be otherwise practiced within the scope of the following claims.

I claim:

1. A portable device for use in curing gel nail preparations on human hands and feet, said device comprising:

a housing having a front wall, a back wall, two side walls, a top and a bottom, said front wall having three horizontal openings therethrough, an uppermost opening, a middle opening and a lowermost opening, three compartments situated within said housing, a first compartment accessed through said uppermost opening, a second compartment accessed through said middle opening and a third compartment accessed through said lowermost opening;

three partitions disposed within said housing, a first partition defining the first compartment, a second partition defining the second compartment and a third partition defining the third compartment, each partition forming the walls of the compartment and including a floor and a ceiling; and three UV lamps, a first UV lamp affixed near the ceiling of the first compartment, a second UV lamp affixed near the floor of the second compartment, and a third UV lamp affixed near the ceiling of the third compartment, whereby when the index and three fingers of the hands are placed flat on the floor of the first compartment and the thumbs are placed flat against the ceiling of the second compartment, radiation from the first UV lamp is directed toward the floor of the first compartment and radiation from the second UV lamp is directed toward the ceiling of the second compartment so the fingernails receive direct radiation, and when the feet are placed flat on the floor of the third compartment, radiation from the third UV lamp is directed toward the floor of the third compartment and the toe nails receive direct radiation.

2. A device as in claim 1 wherein the floor of the first compartment, the ceiling of the second compartment and the floor of the third compartment are substantially flat.

3. A device as in claim 2 wherein the remainder of the partition in each compartment is curved to best concentrate the UV radiation toward the flat ceiling and floors.

4. A device as in claim 3 wherein the inner surfaces of the partitions are coated with a reflective material to reflect the UV light and assist in concentrating same toward the flat ceiling and floors.

5. A device as in claim 1 wherein the first, second and third UV lamps are tubular.

6. A device as in claim 1 wherein the first opening and the third opening are substantially the width of the front wall.

7. A device as in claim 1 wherein the second opening is horizontally centered.

8. A device as in claim 1 wherein the vertical extent of the second opening is greater than that of the first opening.

9. A device as in claim 1 wherein the vertical extent of the third opening is greater than that of the first opening.

10. A device as in claim 1 further comprising a hand rest disposed between the uppermost opening and the middle opening, said hand rest comprising a rounded member extending outwardly from said front wall and extending horizontally at least the length of the middle opening.

11. A device as in claim 1 wherein the first compartment is dimensioned to contain the index and three fingers of both hands.

12. A device as in claim 1 wherein the second compartment is dimensioned to contain the thumbs of both hands.

13. A device as in claim 1 wherein the third compartment is dimensioned to contain both feet.

14. A device as in claim 1 further comprising a power means for activating the UV lamps, said power means selected from the group consisting of line current and a rechargeable battery.

15. A device as in claim 14 wherein the power means comprises both line current and a rechargeable battery.

16. A device as in claim 15 wherein the line current is delivered by means of an electric cord.

17. A device as in claim 16 further comprising a retractable cord mechanism to contain the electric cord when not in use, said retractable cord mechanism being disposed within the housing.

18. A device as in claim 1 further comprising a control panel disposed in the front wall of the housing, said control panel containing timer means to preset the length of time required for curing the gel nail preparations, visible readout means to indicate the time remaining for the curing process, and lamp selection means to activate the desired UV lamps.

19. A portable device for use in curing gel nail preparations on human hands and feet, said device comprising:

a housing having a front wall, a back wall, two side walls, a top and a bottom, said front wall having three horizontal openings therethrough, an uppermost opening, a middle opening and a lowermost opening;

three compartments situated within said housing, a first compartment accessed through said uppermost opening, a second compartment accessed through said middle opening and a third compartment accessed through said lowermost opening;

three partitions disposed within said housing, a first partition defining the first compartment, a second partition defining the second compartment and a third partition defining the third compartment, each partition forming the walls of the compartment and including a floor and a ceiling;

three UV lamps, a first UV lamp affixed near the ceiling of the first compartment, a second UV lamp affixed near the floor of the second compartment, and a third UV lamp affixed near the ceiling of the third compartment; and power means for activating the UV lamps, said power means comprising both line current and a rechargeable battery, whereby the device operates by line current and when the line current is disconnected the device operates by means of the battery, and when the index and three fingers of the hands are placed flat on the floor of the first compartment and the thumbs are placed flat against the ceiling of the second compartment, radiation from the first UV lamp is directed toward the floor of the first compartment and radiation from the second UV lamp is directed toward the ceiling of the second compartment so the fingernails receive direct radiation, and when the feet are placed flat on the floor of the third compartment, radiation from the third UV lamp is directed toward the floor of the third compartment and the toe nails receive direct radiation.

20. A device as in claim 19 further comprising a hand rest disposed between the uppermost opening and the middle opening, said hand rest comprising a rounded member extending outwardly from said front wall and extending horizontally at least the length of the middle opening.

* * * * *